United States Patent [19]

Fabula et al.

[11] 4,186,679

[45] Feb. 5, 1980

[54] TORPEDO DRAG REDUCTION EMPLOYING POLYMER EJECTION

[75] Inventors: Andrew G. Fabula, State College, Pa.; James H. Green, Sierra Madre; William F. Madison, Arcadia, both of Calif.

[73] Assignee: The United States of America as represented by the Secretary of the Navy, Washington, D.C.

[21] Appl. No.: 441,002

[22] Filed: Mar. 17, 1965

[51] Int. Cl.[2] ..... F42B 19/00

[52] U.S. Cl. ..... 114/20 R; 114/67 A

[58] Field of Search ..... 114/20–25, 114/67

[56] References Cited

U.S. PATENT DOCUMENTS

| | | | |
|---|---|---|---|
| 3,150,625 | 9/1964 | Brooks | 114/20 R |
| 3,196,823 | 7/1965 | Thurston | 114/67 A |
| 3,230,919 | 1/1966 | Crawford | 114/67 R |

*Primary Examiner*—David H. Brown

*Attorney, Agent, or Firm*—G. J. Rubens; V. C. Muller; P. H. Firsht

[57] ABSTRACT

Method and apparatus for reducing torpedo drag in which polymer drag reducing material is carried by the torpedo in concentrated form, ambient water is ingested and mixed with the concentrated polymer to produce a seawater-polymer solution of predetermined concentration, and the solution is ejected from the torpedo nose to be swept rearwardly in intimate contact with the exterior surface of the torpedo under torpedo forward motion.

6 Claims, 6 Drawing Figures

TORPEDO DRAG REDUCTION EMPLOYING POLYMER EJECTION

Figure 1:
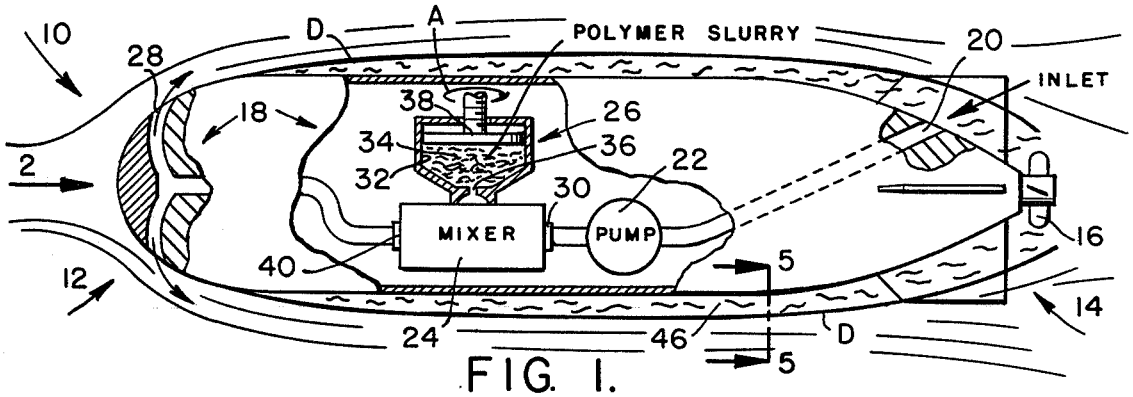

The invention described herein may be manufactured and used by or for the Government of the United States of America for governmental purposes without the payment of any royalties thereon or therefor.

This invention relates to the art of reducing drag of hydrodynamic vehicles, and more particularly to a method and apparatus having particular utility in the reduction of skin friction drag associated with high Reynolds-number (i.e. turbulent) flows adjacent the surface of a torpedo.

For the purposes of this specification and the appended claims the term "solution" shall be used to describe the resultant fluid medium obtained by mixing small relative proportions of a water-soluble polymer material in water, although there is respected opinion that this type of a fluid is in fact a colloidal dispersion or a suspension. This is in accordance with general contemporary usage of the term in the art of water-soluble polymers.

As far as known, heretofore all efforts to reduce skin friction drag in high Reynolds-number flows adjacent the surface of a torpedo have met with sufficiently difficult engineering problems so as to preclude them coming into practical use. The known types of approach include boundary layer suction, introducing a gaseous medium along the surface of the torpedo, and the use of compliant coating. Each of these prior art types of approach basically employs a mode of operation in which the formation of turbulence is effectively "delayed" in the flow stream movement. It is an inherent characteristic of this mode of operation that effective drag reduction is conditioned upon maintaining operational conditions that prevent turbulent flow; that is which maintain laminar flow. Solution of the problem of maintaining such operational conditions is very difficult because of the disturbances in the flow stream adjacent a torpedo, as for example by occurrence of turbulent conditions in the ambient stream, and by roughness on the torpedo surface, in connection with pressure changes caused by the maneuvering of a high speed torpedo. Thus, prior to the present invention, skin friction drag reducing schemes have been generally deemed to impose objectionably difficult requirements for maintaining highly stable operational conditions.

Along with the above mentioned problem there is the ever present desire that any solution of the problem be achieved by means of torpedo components which may be installed in a torpedo with little difficulty in connection with the hydrodynamic form of the torpedo, and with flexibility to install the components where they do not interfere with other critically located torpedo components.

Accordingly, the objectives of the present invention include provision of:

(1) A novel method and apparatus for reducing skin friction drag in high Reynolds-number flows adjacent the surface of a torpedo, and which positively achieves such a reduction irrespective of the occurrence of turbulence along the surface of the torpedo.

(2) Apparatus in accordance with the previous objective which is flexible in its installation on a torpedo, having no critical requirements as to location or body geometry of the torpedo.

(3) A method and apparatus in accordance with the first mentioned objective, and which further effects a reduction of radiated noise from a torpedo.

Figure 3:
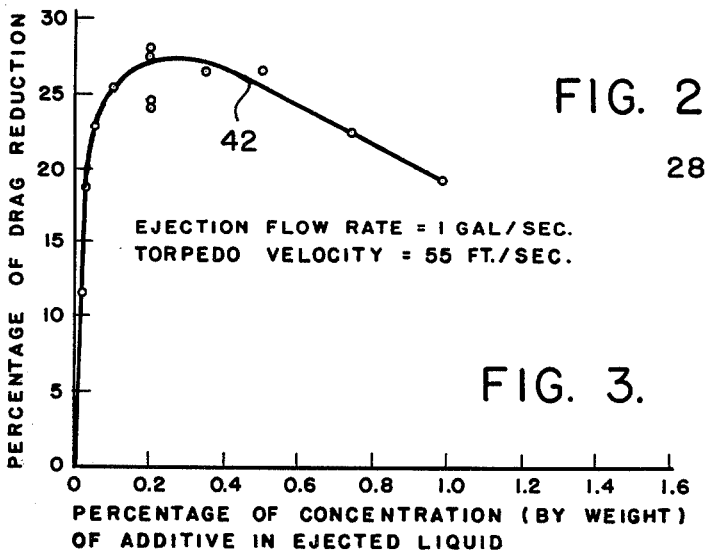
Figure 2:
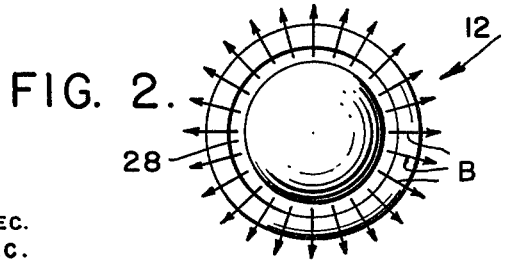
Figure 5:
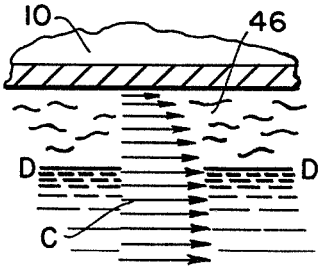
Figure 4:
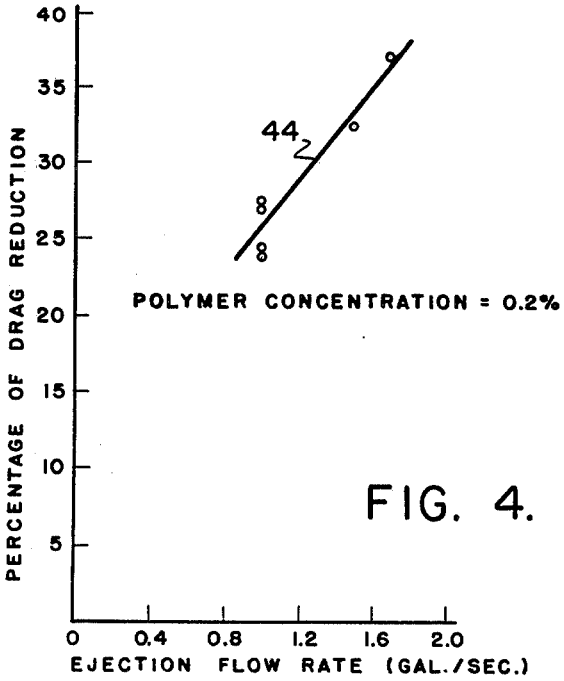
Figure 6:
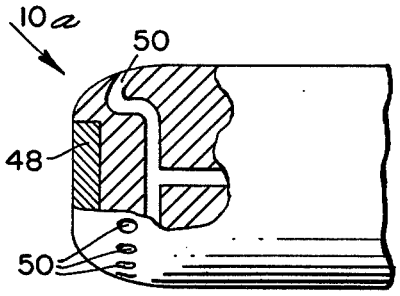

Other objectives and many of the attendant advantages of this invention will be readily appreciated as the same becomes better understood by reference to the following detailed description when considered in connection with the accompanying drawings wherein:

FIG. 1 is a side elevation of a torpedo, which is partially cut-away to show a schematic diagram of an embodiment of the invention, FIG. 2 is a frontal view of the torpedo taken in the direction of arrow 2, FIG. 1, FIGS. 3 and 4 are graphs of certain experimentally determined data, FIG. 5 is an enlarged detail of a zone 5—5 of FIG. 1 showing a portion of the hull of the torpedo and adjacent water medium, and including a diagrammatic representation of the idealized velocity gradient in the boundary layer, and FIG. 6 illustrates a modified form of invention.

Referring now to the drawing, and particularly to FIG. 1, a torpedo 10 has a cylindrical hull, a rounded nose portion 12, and a tapered tail portion 14. At the tail 14 is located a propeller 16. The torpedo is provided with a motor and other necessary apparatus for rotating the propeller, and also provided with stabilizing and steering control surfaces and the associated mechanisms for controlling the steering surfaces, none shown.

Contained within the torpedo is a polymer aqueous solution ejection system 18 for reducing the torpedo's skin friction drag. System 18 comprises a seawater induction port 20, a pump 22, a continuous mixer 24 for mixing seawater and a polymer additive material, an additive injecting device 26 for metering delivery of the additive to the mixer, and an annular discharge port 28 centrally disposed in the nose of the torpedo. Any suitable motor, not shown, is provided to drive pump 22, and this motor could be of a variable speed type. The pump inducts, or ingests, a predetermined flow rate of ambient water through induction port 20 and delivers same to the water inlet 30 of the mixer. It is to be noted that the induction port 20 is located in the tapered portion of the torpedo, where the pump will be aided by the higher static pressure of the ambient water. Contained in a storage chamber 32 of injection device 26 is a water soluble slurry mixture 34 comprising a water-soluble polymer material and a liquid slurry forming base material. Several specific examples of suitable water soluble polymers and slurry mixtures will be described at a later point in this specification. The polymer material is present in the slurry mixture as a powder and the slurry base material is a liquid in which the polymer is insoluble, but which is, itself, either soluble or miscible in water. Preferably a small amount of a gelling agent is also mixed into the slurry mixture to avoid settling of the powder. Stated another way, slurry mixture 34 is an amorphous fluidized suspension of the powdered polymer in the liquid base, the liquid serving as a fluidizing medium. As a fluidized material, mixture 34 may be conveniently stored and injected into the mixer. As a suspension, the polymer powder granules are physically separated with the result that the slurry mixture mixes with the seawater with a minimum of lumping and agglomeration within the mixer which in turn enhances fast solvation or hydration of the polymer molecules. If desired, mixture 34 may also include other materials conventionally used with water soluble polymers to increase their rate of solution. The bottom portion of storage chamber 32 is funnel-shaped and communicates with the mixer inlet 36 for receiving the additive. The mixer inlet also forms a metering orifice, as shown. Provided in device 26 is a screw press element 38 comprising a screw portion which is connected at its bottom end with a circular press plate which slidingly engages the cylindridal wall of the storage chamber. When the screw is rotated at a predetermined turn rate, by any suitable means as symbolically shown by arrow A, it exerts a force upon the slurry mixture 34 and meters a predetermined flow rate of it into the mixer. Mixer 24 is of any suitable construction that provides continuous mixing and avoids scission of the long molecules, such as a venturi type mixer, or other conventional mixers known in the art of processing polymer solutions. The composition of the slurry mixture, and the residence-mixing time of mixer 24, are matched to provide at the mixer outlet 40 a dilute aqueous solution of the polymer material of a predetermined concentration and with the polymer substantially completely dissolved. The concentration of the polymer solution is below those concentrations at which such solutions tend to thicken into a gelled condition, and typically may have the consistency of a slimy mucus. The passage forming the annular discharge slot is slightly raked in the rearward direction so that the flow is directed therefrom at a slight rearward angle. If desired, the discharge slot may be formed by a spring loaded poppet rather than the fixed geometry arrangement shown.

The types of water soluble polymer materials suitable for use as an additive in system 18 have been found to be characterized as the higher molecular weight, water-soluble polymers, having long chain and linear, rather than highly branched, molecule structures. A preferred type of polymer material is the synthetic poly (ethylene oxide) polymer having a molecular weight of approximately four million or more. One specific material of this type is commercially available from the Union Carbide Corporation as Water Soluble Resin (WSR) 301, and commonly called "Polyox". Another example of suitable material is natural guar gum having a molecular weight of approximately 200,000, commercially available from the Stein-Hall and Company, New York. A still further example of a suitable material is the higher molecular weight synthetic polyacrylamide-type polymers having molecular weights of approximately two million, such as Separan AP-30 made by Dow Chemical Company. An example of a suitable slurry mixture comprises 30–60 percent powdered polymer material, 35–65 percent of a suitable liquid fluidizing medium such as isopropyl alcohol or acetone, and 3–5 percent of a gelling agent, such as silica.

Operation of torpedo 10 is as follows. The torpedo is propelled in the forward direction at normal torpedo speed, which may be on the order of 75 feet per second (fps). The speed of the motor driven pump 22, and the rate at which the screw portion of injector 26 is turned, are regulated to provide the desired concentration and flow rate of polymer-aqueous solution at the output of mixer 24. From the mixer, the solution flows to discharge port 28, and is thence ejected into the ambient water flow stream adjacent the torpedo nose in a radially outwardly and slightly rearwardly directed flow pattern extending fully 360° about the torpedo axis, as symbolically indicated by arrows B, FIG. 2. It will be understood that the effect of the relatively high forward motion of the torpedo is that the flow stream tends to sweep the ejected polymer solution back along the hull of the torpedo in a generally annular or sheath-like flow pattern.

As an indication of the magnitude of reduction of torpedo drag realizable with the system 18, two typical experiments will be described.

In one series of experimental tests, which is herein identified as example I, pre-mixed polymer solutions of varying concentration of polymer were ejected from a torpedo having a length of ten feet, a diameter of fifteen inches, and a nominal weight of 700 pounds, and at an ejection flow rate of one gallon per second during a series of separate torpedo runs. The previously mentioned "Polyox" WRS 301 was employed as the polymer solution in these tests, and the torpedo was propelled at 55 fps. FIG. 3 shows a curve 42, through a plot of the various percentages of drag reduction obtained for the varying concentration of polymer in the aqueous solution.

In another series of experiments, example II, a 0.2 percent solution of "Polyox" WRS-301 was ejected at a variety of ejection flow rates over a series of individual torpedo runs, the conditions otherwise being the same as in example I. FIG. 4 shows a curve 44 through a plot of the percentages of drag reduction at the various flow rates. Various other experiments, which for sake of brevity are not disclosed herein, were also performed in order to study the characteristics of the drag reduction phenomena, such as the ejection of the polymer-aqueous solution from holes circumferentially located about the middle of the torpedo, the extending of the length of the torpedo by the addition of a lengthening section, the operation of the torpedo at different velocities, and the use of different types of propellers.

A modified form of the invention, shown in FIG. 6, illustrates a homing torpedo 10*a* of a type having an acoustic transducer 48 mounted in a blunt nose. The solution of polymer and seawater from the continuous mixer is ejected through a set of equiangularly and relatively closely spaced small rearwardly raked holes 50 drilled about the circumference of the torpedo 10*a* slightly aft of the nose. Such construction has been found to be substantially as effective as the annular port of FIG. 1, and in addition constitutes a highly convenient way of installing the ports in a torpedo having a transducer in its nose.

It will also be appreciated that the invention is not limited to the injection of polymer material into a mixer in the form of a slurry, but by choice of a proper mixer and additive feed device the polymer material could be carried by the torpedo in the form of a powder for direct mixing with the inducted seawater.

Although the invention has been described in connection with the purpose of drag reduction, it has been found that the ejection of the polymer aqueous solution about the torpedo additionally causes an appreciable reduction in radiated noise from a torpedo. Both the reduction of drag and reduction of radiated noise may assume critical significance in certain torpedo applications. For example, where a torpedo must search for a long time before it detects a target, the target may, by early acoustic detection of the radiated noise, take successful evasive action.

The nature of the phenomenon illustrated by the plot of FIGS. 3 and 4 is not completely understood. Nevertheless a tentative conclusion as to the fundamental physical mode by which the ejected polymer-aqueous solution effects the drag reduction demonstrated by the curves 42 and 44, FIGS. 3 and 4, has been presently drawn, as diagrammatically illustrated in FIGS. 1 and 5. A hydrodynamic boundary layer region 46 of water-flow surrounds the torpedo hull, the layer being of increasing thickness in the rearward direction. Briefly, and as a somewhat generalized explanation, this layer of flow is characterized by a gradient of stream velocities, symbolically indicated by arrows C, FIG. 5, in a direction normal to the hull, and its nominal outer limit, symbolically indicated by line D, is conventionally defined as a line through the points at which the velocity gradient has essentially reached free stream velocity. The boundary layer 46 is characterized by turbulent mixing between adjacent flow layers when the flow has high Reynolds number properties, as is normal with torpedoes. Such turbulence is characterized by high skin friction. Pursuant to a variety of experimental findings, which include both those mentioned in this specification and other experiments not mentioned in this specification, it is believed that the drag reduction demonstrated by curves 42 and 44, FIGS. 3 and 4, is the result of the reduction in skin friction drag due to the damping effect of the long chain, linear, polymer molecules upon the intensity of turbulence in the boundary layer. Accordingly, mixing and dilution of the polymer solution in the boundary layer is believed a primary factor determining the degree of torpedo drag reduction. It is not critical whether the polymer-aqueous solution is introduced into the boundary layer ahead of or behind the transition point at which turbulent flow commences within the boundary layer since the presence of the polymers give positive and effective damping of turbulence under either condition. The significance of this positive turbulence damping mode of operation is that it provides flexibility in the installation of the system in a torpedo, and does not place a burden of care in a hydrodynamic design to assure stabilized laminar flow, nor does it require exact definition of a transition point. There is also considerable flexibility in the location and geometry of the ejection ports, as has been illustrated by the modification of FIG. 6. Referring again to FIG. 1, pursuant to the above stated conclusion, drag reduction in connection with torpedo 10 is achieved as the result of the ejection of the polymer-aqueous solution through discharge port 28 in a manner in which the polymer molecules are swept back along the surface of the torpedo to there be dispersed and mixed in the boundary layer flow. This has been diagrammatically illustrated in FIG. 1, where the polymer molecules, symbolically indicated by short wavy lines, are shown distributed throughout the boundary layer. (Polymer may also be present outside boundary layer) Referring again to plot 42, FIG. 3, it will be noted that the drag reductions obtained diminish for solution concentrations in excess of approximately 0.3%. Pursuant to the above stated conclusion, it is believed that this diminishing return is due to the poor dilution characteristics exhibited by polymer-aqueous solutions where the concentration of polymer is increased to the point where the solution becomes relatively thick in approaching a gel condition. Such poor dilution characteristics would, it is reasoned, impede dispersal and mixing of the polymer molecules in the boundary layer, which in accordance with above stated conclusion would in turn result in diminished drag reduction effectiveness. Thus, the point at which poor dilution characteristics of a solution outweigh the number of polymer molecules dispersed and mixed into the boundary layer constitutes an upper limit of concentration of ejected solution for optimum effectiveness.

Whatever the reason for obtaining the drag reduction with rejection of a polymer-aqueous solution, it has been definitely established that ejection of polymer solutions from a torpedo in accordance with the principles of this invention is effective in providing drag reduction with very dilute concentrations of polymer solution, that systems for the polymer solution may be installed in a torpedo with little difficulty in connection with the hydrodynamic form of the torpedo or interference with other critically located torpedo components, and that the amount of noise radiated from torpedoes employing such a system is appreciably reduced.

Obviously many modifications and variations of the present invention are possible in the light of the above teachings. It is therefore to be understood that within the scope of the appended claims the invention may be practiced otherwise than as specifically described.

What is claimed is:

1. In combination with a torpedo of the type having an elongated body having nose and tail ends, and adapted to be self propelled through the water;

(a) means for continuously ingesting ambient water into the hull at a predetermined flow rate, (b) means for receiving and holding a charge of a quick solvation, polymer-amorphous suspension mixture, said mixture containing a powdered form of hydrodynamic drag reducing water soluble polymer material having a high molecular weight and linear, long-chain, molecular structure and a quick solvation suspending medium, (c) a liquid solution continuous mixing means having an inlet for solvent, an inlet for additive, and an outlet for the output solution, and having a characteristic residence-mixing time, said ingested seawater being communicated to the mixing means inlet, said mixing means being so constructed and arranged to mix the seawater and the polymer material in a manner in which the solvated and hydrated form of polymer molecules present in the output solution substantially retain their linear, long-chain, molecular structure, (d) means for dispensing said charge of polymer-amorphous suspension mixture into the additive inlet of the means for mixing at a predetermined rate to produce a concentration of polymer material in the output solution of the mixing means between the limits of 0.05% and 1.0% by weight, (e) said polymer-amorphous suspension mixture adapted to match the characteristic residence-mixing time of the means for mixing to cause the polymer material to be present in the output solution of the mixing means in substantially solvated and hydrated form as it issues from the outlet, and (f) ejection port means extending through the hull of the torpedo at the nose end thereof, said output solution from the mixing means being communicated to the ejection port means, said ejection port means being raked in the direction of the adjacent ambient stream flow to cause the solution to be swept rearwardly along the torpedo in intimate contact with its exterior surface under torpedo forward motion.

2. Apparatus in accordance with claim 1, said torpedo being a type further having a blunt frontal face, (g) said ejection port means comprising a plurality of rearwardly raked ejection apertures equiangularly disposed about the hull of the torpedo adjacent the blunt frontal face.

3. Apparatus in accordance with claim 1, wherein;

(a) said polymer material is polyethylene oxide.

4. Apparatus in accordance with claim 1, wherein the quick solvation suspending medium comprises:

(a) a liquid slurry forming agent consisting of a liquid base fluidizing medium which is miscible in seawater and a gelling agent.

5. Apparatus in accordance with claim 1, wherein the quick solvation polymer-amorphous suspension mixture comprises:

(a) 30–60 percent, by weight, powdered polymer material selected from the class consisting of polyethylene oxide, guar gum, and polyacrylamide, (b) 35–65 percent, by weight, of a liquid fluidizing medium selected from the class consisting of isopropyl alcohol and acetone, and (c) 3–5 percent of gelling agent.

6. A method for reducing skin friction drag associated with high Reynolds-number turbulent flows adjacent the surface of a torpedo, said torpedo being of a type having an elongated body and adapted to be self propelled through the water, said method comprising the steps:

(a) ingesting a continuous flow of ambient seawater, (b) adding to the flow of ingested seawater a quick solvation, polymer-amorphous suspension mixture, said mixture containing a powdered form of hydrodynamic drag reducing water soluble polymer material having a high molecular weight and a linear, long-chain, molecular structure, and containing a quick solvation suspending medium, said mixture added to the seawater at a predetermined rate to produce a concentration of polymer material in the flow between the limits 0.05% and 1.0%, by weight, (c) mixing the seawater and additive mixture to produce a seawater-polymer solution flow in which the polymer material is present in substantially solvated and hydrated form, and in a manner in which the solvated and hydrated form of polymer molecules retain their linear, long-chain, molecular structure, (d) ejecting the seawater-polymer solution from the nose of the torpedo with a component of ejection motion in the direction of flow of the adjacent ambient stream to cause the solution to be swept rearwardly along the torpedo in intimate contact with its exterior surface under torpedo forward motion.

* * * * *